US005865440A

United States Patent [19]

Pulkrabek

[11] Patent Number: 5,865,440

[45] Date of Patent: Feb. 2, 1999

[54] FOAM ARCHERY TARGET

[76] Inventor: Larry Pulkrabek, 1930 Ridgewood, White Bear Lake, Minn. 55110

[21] Appl. No.: 900,921

[22] Filed: Jul. 28, 1997

[51] Int. Cl.[6] ..... F41J 3/00

[52] U.S. Cl. ..... 273/408

[58] Field of Search ..... 273/403, 404, 273/407, 408

[56] References Cited

U.S. PATENT DOCUMENTS

| | | | |
|---|---|---|---|
| 3,088,738 | 5/1963 | Meyer | 273/407 X |
| 4,076,246 | 2/1978 | Meyer | 273/408 X |
| 4,126,501 | 11/1978 | Croll | 273/408 X |
| 4,244,585 | 1/1981 | Croll | 273/408 |
| 4,940,244 | 7/1990 | Batts, III | 273/403 |
| 5,465,977 | 11/1995 | Mann | 273/408 |

*Primary Examiner*—William H. Grieb
*Attorney, Agent, or Firm*—D. L. Tschida

[57] ABSTRACT

An archery target constructed of compressed layers of foam. Layers of cross linked, closed cell polyethylene foam of ⅛ to ¼ inch thickness and a density of 2 to 4 pounds are stacked and compressed between support platens positioned to maintain the compressive forces over the central portion of the target. Band retainers are secured around the target to maintain compression and retain the layers in registry to one another. A weather resistant cover can be trained around the baled target and a handle can also be mounted to the binding support platens.

16 Claims, 3 Drawing Sheets

FOAM ARCHERY TARGET

BACKGROUND OF THE INVENTION

The present invention relates to archery targets and, in particular, to a target and constructed of compressed foam strips banded between a pair of opposing boards, which target may be covered with a weather resistant membrane.

A variety of archery targets or backstops have been developed over the years to safely capture an arrow with minimal damage to the target. Depending upon the type of arrow point, the target life will vary. Penetration by field or practice points, which do not provide cutting surfaces, produces minimal wear and tear to the target. That is, the material with arrow point penetration and removal tends to merely compress and re-expand. A broadhead with multiple cutting surfaces, in contrast, cuts the material. With repeated penetrations, the cuts can intersect and overlap which can cause the loss of sections of the material. Material loss can be exaggerated when arrows are shot from different angles, which results in overlapping cuts in three dimensions.

A variety of materials have been used to create targets. Common materials used in both indoor and outdoor applications are straw, excelsior (i.e. wood strands), and cardboard. Dirt, layered sod, rubber belting and various types of foam targets have also been used to stop broadheads on outdoor ranges.

U.S. Pat. No. 4,940,244 discloses a target constructed of compressed layers of cardboard. The layers are compressed between end boards which that are placed under compression by threaded through rods. Protection must be provided with such targets when used outdoors. The coarse materials also tend to restrict arrow removal.

U.S. Pat. No. 4,244,585 discloses a target constructed of a gathered and wound thermoplastic film which is formed into a circular disk and where the circular surface of the disc forms the target face. A cover sheet is applied over one or more vertically stacked disks and which are placed on edge. Still other targets including vertically stacked materials are known. Such targets typically provide a relatively few layers, for example, facing and backing layers with a core layer mounted at the center.

U.S. Pat. No. 5,465,977 discloses a horizontally layered target which is constructed of layers of carpeting. The target face is formed by the edges of the horizontally stacked layers. Bands are fitted around the stacked layers and drawn tight to compress the layers. The banding process, however, tends to place an uneven compression on the layers with particularly less compression in the center region. The carpet material is also not compatible with broadheads.

Targets constructed of molded, single pour, open and closed cell foams of various densities (e.g. polyurethane and polystyrene foams) and covered bats of polyester materials are also known. Such targets are used with broadheads and may include sections, which are replaced after protracted tear out has occurred. Many of the foregoing types of targets are also shown at an article by Tom Kacheroski in *Archerv Business* at pp. 52–53 (March/April, 1997).

Targets filled with fibrous materials in the manner of a pillow are also known. When used with broadheads, the covering for these targets must be frequently replaced.

Although all of the foregoing targets will stop an arrow, many do not particularly accommodate broadheads. That is, a broadhead will either become trapped in the target or will cause tear out with relatively few shots. The stacked materials of some are also relatively heavy and susceptible to absorption of moisture. The thickness of the layers can also induce arrows to align at differing angles, depending upon whether the point first encounters the core of the material or an interstice at the layers, which can cause damage from other arrows being shot into the target.

In appreciation of the deficiencies of known targets, the present target was developed to provide a relatively light weight, weather resistant, and tear out resistant target that is compatible with both field and target points and broadheads and is useable both indoors and outdoors. The target is constructed of compressed layers of cross linked, closed cell foam. The foam exhibits a thickness of 1/16 to 3/8 inches and the compression pressure is established to compress the stacked layers approximately 5 too 20% from a loose stacked condition.

SUMMARY OF THE INVENTION

It is accordingly a primary object of the invention to provide an archery target which is useable indoors and outdoor with field and target points and broadheads.

It is a further object of the invention to provide a target constructed of horizontally stacked foam layers and a target surface defined by the edges of the layers.

It is a further object of the invention to provide a target constructed of layers of 2 to 4 lb. density foam at a thickness of 1/16 to 3/8 inches, which layers are evenly compressed and bound such that a uniform pressure is maintained over the center of the target.

It is a further object of the invention to provide a target having rigid platens bound at the opposite ends of the target to retain the center compression.

It is a further object of the invention to provide a target that is covered with a weather resistant cover and which may include a carry handle.

It is a further object of the invention to bind the layers with bands or other retainers which maintain the layers in registry with one another over the entire height of the target.

Various of the foregoing objects, advantages and distinctions of the invention are obtained in a presently preferred archery target constructed of stacked layers of a cross linked, closed cell polyethylene foam. The layers exhibit an edge thickness of 1/8 to 1/4 inch and a density in the range of 2 to 4 lbs. The stacked foam layers are compressed between a pair of platens or boards of shorter length than the foam layers. The boards are mounted at the bottom and top of the layers. The layers are compressed in a cage beneath a hydraulic press plate and banding members are fitted around the baled layers to retain the compression, especially over the central region of the target. The bands also cut into the layers to maintain the registry of layers over the entire target. A weather resistant cover material can be mounted around the circumference of the target. A carry handle can be attached to target or the target may be supported to a rolling stand. A tether or ground anchor might also be provided to prevent theft and secure the light weight target against tipping.

Still other objects, advantages and distinctions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

DESCRIPTION OF THE PREFERRED EMBODIMENT

Figure 1:
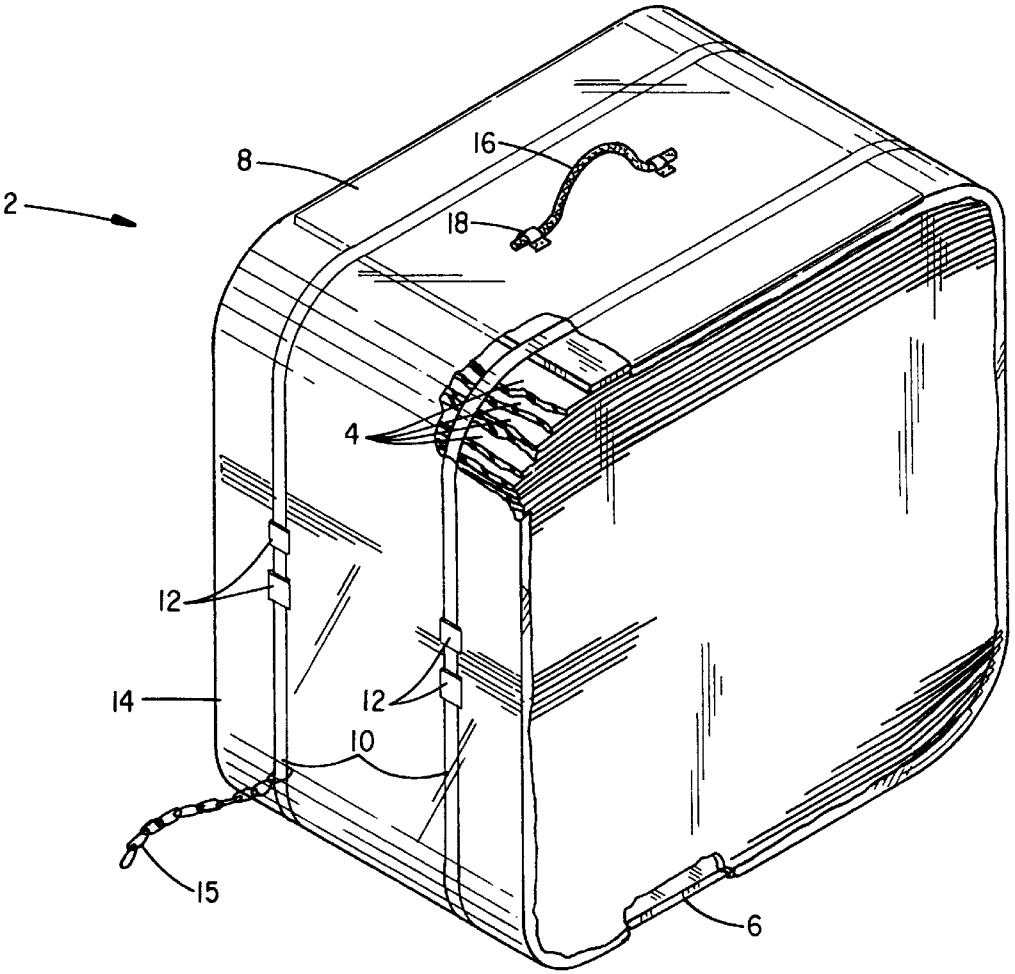
FIG. 1 is a perspective drawing shown in partial cutaway view to a layered foam target.

Referring to FIG. 1, a layered foam target 2 is shown in perspective view. The target 2 can be used to advantage either indoors or outdoors and can be shot with of field or target points or broadhead tipped arrows. The target 2 is particularly accommodating of broadheads. The target 2 is light weight and durable and able to absorb thousands of penetrations with only minimal deterioration.

The target 2 is constructed of numerous layers 4 of stacked foam. The foam is weather resistant and can be used either indoors or outdoors. The foam layers 4 are stacked and compressed within a baling assembly 50, reference FIGS. 2 and 3. A base board, binding support or platen 6 is positioned in the assembly 50 and an appropriate number of layers 4 are stacked and arranged in alignment to each other over the base board 6. A covering board or platen 8 is eventually positioned over the layers 4. The size of the boards 6 and 8 are selected to be shorter than the length of the layers 4 and provide an inset of approximately 2 to 6 inches from each side of the target 2.

The collection of layers 4 are compressed to a preferred pressure which reduces the stacked layers approximately 5% to 20% of their loose fill height. Stated differently, the layers 4 are typically stacked into the baling chamber 50 to a height from 4 to 6 inches greater than the compressed height. Upon compressing the layers 4, a number of bands 10 (e.g. steel, nylon webbing or other durable materials) are fitted around the circumference of the target 2 and the band ends are secured with crimp fasteners 12. The bands 10 when drawn tight and upon the release of the target from the baler 50, cut into the ends of the layers 4, which serves to maintain the registry of the layers 4.

Upon release of the baled target 2 from the baler 50, the boards 6 and 8 maintain a relatively uniform and constant pressure over the center of the target 2 from top to bottom with essentially no deformation of the layers 4 through the center of the target, except for a rounding at the corners. Otherwise, the layers 4 are not glued or bonded together. Presently, the boards 6 and 8 are formed of ½ inch plywood, although support platens constructed of other materials and thicknesses can also be used, provided they do not deform under compression and upon release from the baler 50.

The completed target 2 may also be wrapped over or sealed by a cover sheet 14, although the foam layers 4 are inherently insensitive to weather. A length of weather and ultraviolet resistant material, such as a TYVEK or a heat shrink polyethylene, of a suitable width, can be used to form the cover 14. The cover 14 can be fitted beneath the bands 10 by fitting the cover into the baling cage prior to stacking the board 6, layers 4 and board 8 or can be mounted over the target upon release from the baler 50. A leather or rope handle 16 can be secured to one of the boards 6, 8 with staples 18. A variety of handles and other fasteners can be substituted depending upon the size of the targets 2. Alternatively, the target can be supported or banded to a wheeled dolly (not shown). A leather handle 16 is presently used with the target 2. A tether chain or cable 15 may also be secured to the bands 10 to prevent theft and anchor the target 2.

Each of the layers 4 consists of a cut piece of a ⅛ to ¼ thick cross linked foam. A cross linked foam exhibits greater self healing at each puncture hole and provides longer target life, especially when the target 2 is used with broadheads. The relatively thin layers 4 and type of foam also produce very little compression about the arrow shaft and head. The foam also prevents the arrow from turning during removal which assures that broadheads follow the same hole on ingress and egress, without tearing. Arrows are therefore easily withdrawn without resort to arrow gripping devices or excessive arm, shoulder or tugging body movement.

The foam may be open or closed cell, although a closed cell polyethylene foam is preferred and which is less susceptible to the intrusion of moisture and deterioration from ultraviolet rays. A variety of foam materials, such as polyethylene or polyurethane foams or blends thereof may also be used to advantage.

A foam having a density of 2 to 4 lbs. is also preferred. In contrast to higher density foam materials, it is believed the low density material facilitates arrow removal without the friction or adherence of the layered material to the arrow that is exhibited by higher density and continuous pour foam targets. For example and for targets constructed of cross linked, closed cell polyethylene foam at a 2 to 4 pound density, the arrows are readily removed with one hand and without having to jerk or throw the body into the removal motion. The weight of the target 2 is also reduced when using a low density foam and which is advantageous for the archer who wants to transport a target to his or her hunting camp.

The dimensions of the layers 4 can be selected to preference. Presently, the targets 2 are constructed in three sizes, i.e. 28"×28"×18"; 14"×14"×12"; and 48"×28"×18", and which respectively weigh approximately 15, 40 and 75 pounds.

Figure 2:
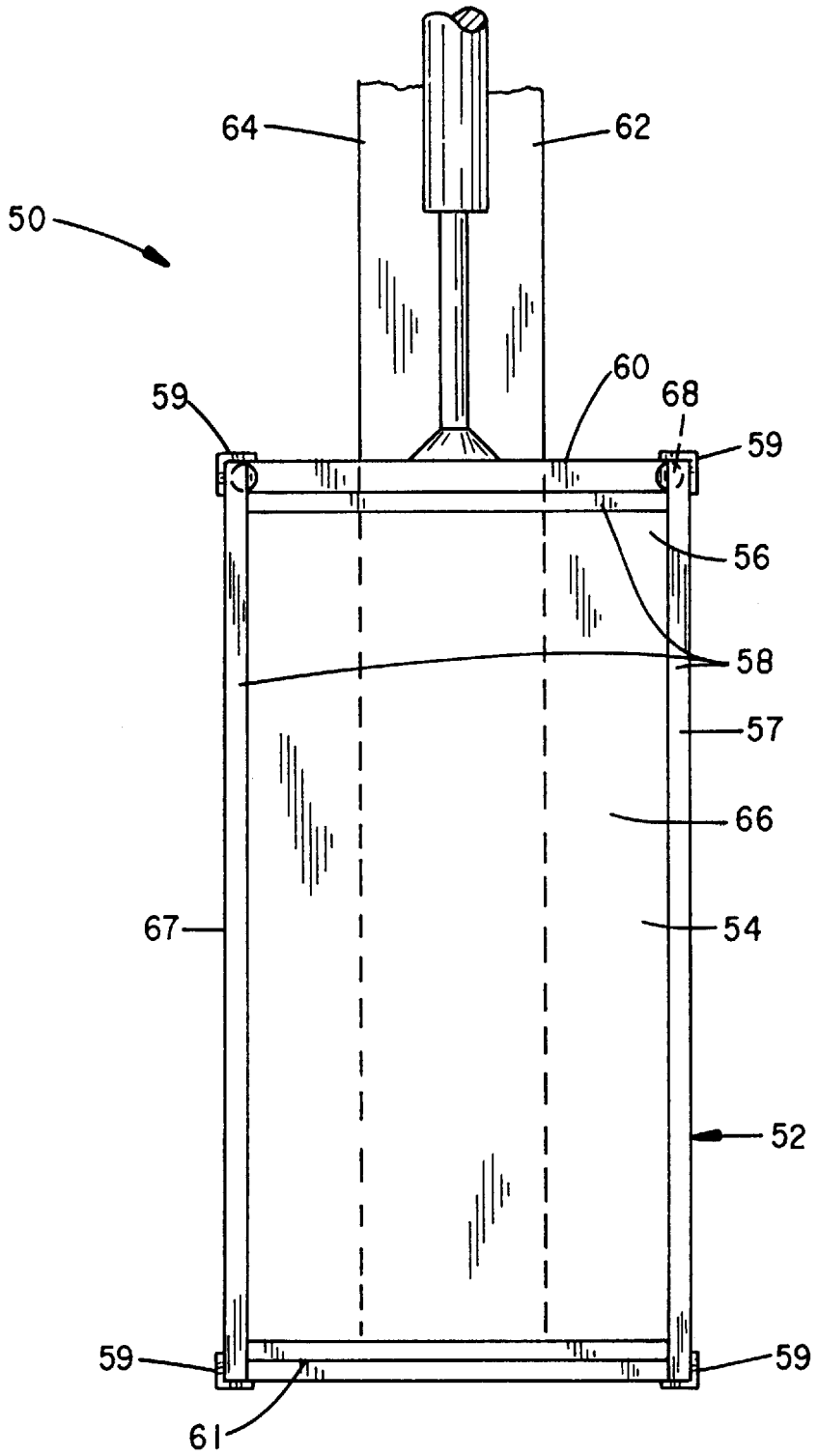
FIG. 2 is an elevation view to an assembly for uniformly compressing and banding the layered material.
Figure 3:
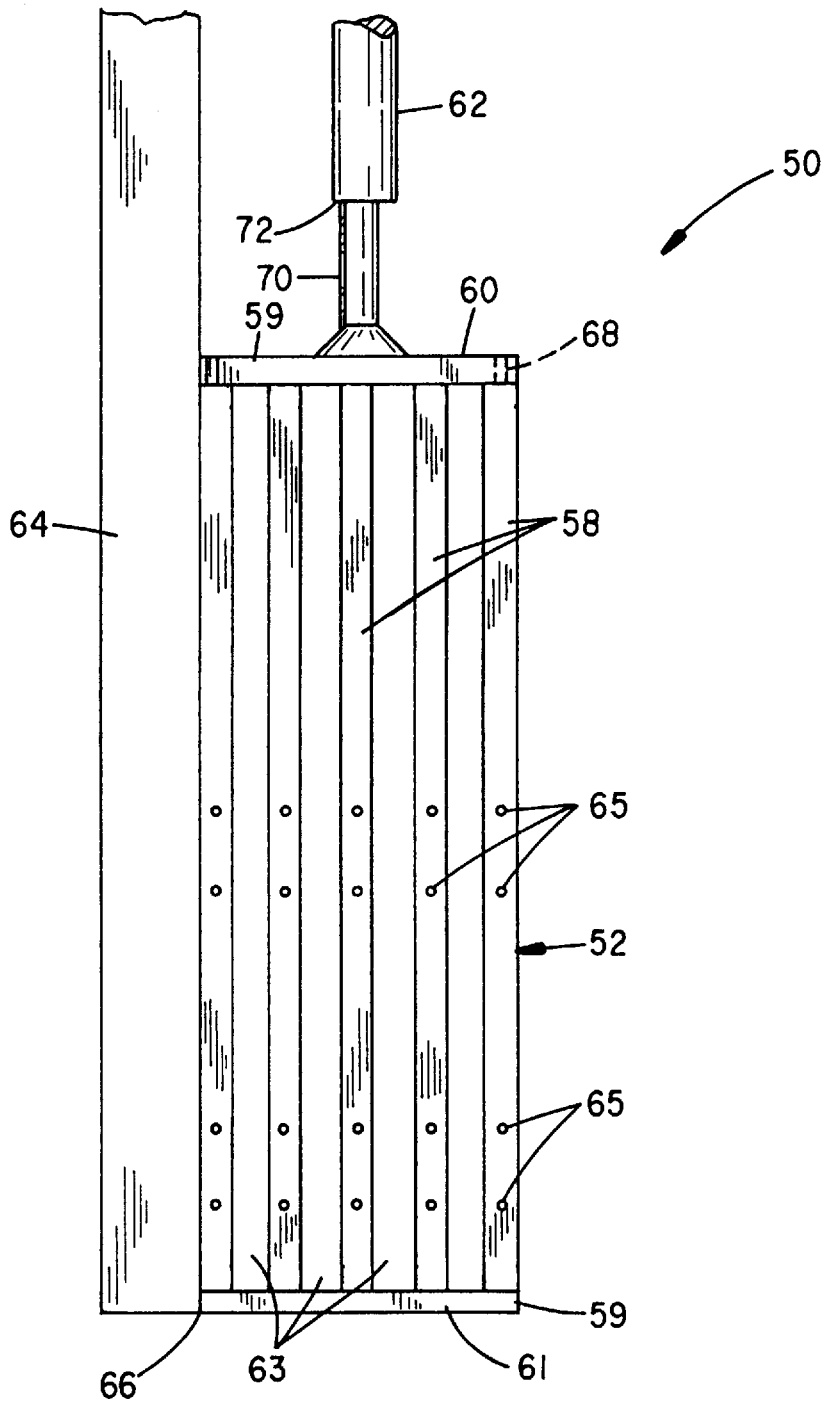
FIG. 3 is a side view to the compression assembly.

With attention to FIGS. 2 and 3, views are shown to a baling or pressing assembly 50 which is used to compress the layers 4 to form. The baler 50 is constructed of a housing 52 having an open front 54 and an open top 56. The housing walls are constructed of a number of channel members 58. The members 58 are spaced apart from each other along angle iron supports 59 at the edges of the walls and flat webs of the members 58 are positioned toward the layers 4. The members 58 at the side walls 57 and 67 align to members 58 at a bottom wall or base plate 61 and with a number of other channel members 58 that are secured to the bottom of a pressing plate 60. A number of channel spaces 63 are thereby presented between the aligned vertical columns and horizontal rows of the members 58 and through which the bands 10 can be directed to encircle the compressed target 2.

A 20 ton hydraulic ram 62 is secured to a column 64 that rises from a back surface 66 of the housing 52. A piston of the ram 62 controls the compression forces placed on the plate 60. Rollers 68 can be fitted to the corners of the plate 60 to facilitate movement of the plate 60 within the housing 52. A key 70 at the piston and keyway 72 the cylinder can also be used to assure proper movement of the plate 60. The bottom wall 61 may also be raised and secured with lynch pins (not shown) at differing heights defined by holes 65 along the side walls 57 and 67. Although the baler 50 provides a uniform compression at the target 2, other baling assemblies might also be used when constructing the target 2.

In distinction to other foam targets molded from a single foam or constructed of a few, relatively thick full size layers that are placed back to back, the target 2, after exposure to thousands of arrows, has demonstrated substantially no degradation to target points. No appreciable tear out has also been noted when shot with broadheads. The dept of arrow penetration is also substantially the same, regardless of the point type. The force necessary to remove an arrow, whether tipped with a target or field point or a broadhead, is also essentially the same for all arrows and which removal can be effected without the need for a separate arrow gripping holder. Such holders are typically required when shooting target and field points into cardboard or other fibrous materials or broadheads into solid foam.

It is postulated the relatively constant penetration depths and low removal force are due to the low density of the thin layers, which trap the arrows between layers versus some arrows being stopped in the core of a layer 4 and others at the interface between layers 4. This hypothesis is also believed supported in that groups of arrows do not exhibit vertical misalignment, which can result when some arrows are supported in the cores of various layers 4 versus between layers 4. Due to the relatively thin thickness of the layers 4, the arrows are not readily supported by a single layer 4. The layers 4 are therefore desirably selected to be closer to ⅛ inch than possibly ¼ or ⅜ inches.

The low density material also does not expand around the arrow wall and head to create friction. The low density material also produces a target 2 that is relatively light in weight, for example a foam target 2 of comparable dimension to either a layered carpet or cardboard target would be 50 to 200 pounds lighter. The desirable durability, light weight, environmental insensitivity and low resistance to arrow removal provide distinct advantages of the target 2 over known targets. The ability to possibly replace damaged layers 4 by re-banding the target 2 adds a further advantage over other molded foam targets, which require either complete replacement or repair with core piece, such as in animal targets where most shots are directed into a vital area.

While the invention has been described with respect to a preferred construction, still other constructions may be suggested to those skilled in the art. For example and although a target 2 of uniformly thick layers is disclosed, layers 4 of differing thickness might also be incorporated into the target 2. The foregoing description should be construed to include all those embodiments within the spirit and scope of the following claims.

What is claimed is:

1. An archery target comprising:

a) first and second support platens;

b) a plurality of layers of foam stacked and compressed between said first and second support platens and wherein said first and second platens are shorter than said layers; and c) means for retaining the stacked foam layers in registry to one another as an integral assembly, whereby a shooting face of said target is presented at a surface defined by the edges of said plurality of layers.

2. An archery target as set forth in claim 1 wherein said layer comprises a polyethylene foam having a thickness in the range of 1/16 to ⅜ inches.

3. An archery target as set forth in claim 2 wherein said foam comprises a closed cell polyethylene material having a density selected in the range of 2 to 4 pounds.

4. An archery target as set forth in claim 3 wherein said foam comprises a cross linked foam.

5. An archery target as set forth in claim 3 wherein said foam layers and support platens are bound together with a plurality of bands mounted about the periphery of said target.

6. An archery target as set forth in claim 3 wherein said first and second support platens comprise a pair of boards.

7. An archery target as set forth in claim 6 wherein a handle is secured to one of said boards.

8. An archery target as set forth in claim 1 wherein said layers comprise a cross linked foam.

9. An archery target as set forth in claim 1 including tether means for anchoring said target against theft and tipping.

10. An archery target comprising:

a) first and second boards;

b) a plurality of layers of a closed cell, cross linked polyethylene foam having a density selected in the range of 2 to 4 pounds stacked and compressed between said first and second boards and wherein said first and second boards are shorter than said layers;

c) means mounted around the periphery of said target for retaining the stacked layers as an integral assembly.

11. An archery target as set forth in claim 10 wherein said foam layers and boards are bound together with a plurality of bands mounted about the periphery of said target.

12. An archery target as set forth in claim 10 wherein a handle is secured to one of said boards.

13. An archery target as set forth in claim 10 including a weather resistant cover bound around the periphery of said layers and said first and second boards.

14. A method for constructing an archery target comprising:

a) stacking a first support platen within a housing having a plurality of open channel spaces in top, bottom and side walls;

b) stacking a plurality of layers of a closed cell, cross linked polyethylene foam over said first support platen, wherein each layer has a thickness in the range of ⅛ to ¼ inch and a density selected in the range of 2 to 4 pounds;

c) stacking a second support platen over said stacked layers, and wherein said first and second support platens are shorter than each of said layers;

d) positioning a compression plate over said second support platen;

e) compressing said first and second support platens and layers to a height in the range of 5% to 20% of the loose fill height;

f) securing a plurality of bands around the compressed first and second support platens and layers; and g) releasing the banded first and second support platens and layers from said housing, whereby said bands bite into said layers and said support platens maintain the target at a compressed shape with a uniform compression over the center of said target.

15. A method as set forth in claim 14 wherein said first and second support platens comprise boards and including the fitting of a handle to at least one of said boards.

16. A method as set forth in claim 14 including the fitting of a weather resistant cover around the periphery of said layers and support platens.

* * * * *